US006471084B2

(12) United States Patent
Erb

(10) Patent No.: US 6,471,084 B2
(45) Date of Patent: Oct. 29, 2002

(54) FOOD DELIVERY TRAY WITH RIBBED UPPER SURFACE

(75) Inventor: Daniel P. Erb, West Lafayette, OH (US)

(73) Assignee: Jones Metal Products Co., West Lafayette, OH (US)

( * ) Notice: Subject to any disclaimer, the term of this patent is extended or adjusted under 35 U.S.C. 154(b) by 16 days.

(21) Appl. No.: 09/768,546

(22) Filed: Jan. 25, 2001

(65) Prior Publication Data

US 2002/0108955 A1 Aug. 15, 2002

(51) Int. Cl.[7] ..... B65D 41/00; A47J 27/00

(52) U.S. Cl. ..... 220/359.4; 220/575; 220/556

(58) Field of Search ..... 220/575, 359.1, 220/359.4, 359.2, 556; 206/541, 548

(56) References Cited

U.S. PATENT DOCUMENTS

| | | | | | |
|---|---|---|---|---|---|
| 4,044,941 | A | * | 8/1977 | Knudsen | 220/359.4 |
| 4,215,797 | A | * | 8/1980 | Chen | 220/359.4 |
| 4,595,117 | A | * | 6/1986 | Walter | 220/359.4 |
| 4,605,142 | A | * | 8/1986 | Itoh et al. | 220/359.4 |
| 4,838,444 | A | * | 6/1989 | Bitel | 220/575 |
| D318,207 | S | | 7/1991 | Anderson | |
| 5,368,183 | A | * | 11/1994 | Singer | 206/541 |
| 5,419,451 | A | | 5/1995 | Bitel, Jr. | |
| 5,632,924 | A | * | 5/1997 | Gics et al. | |
| 5,853,105 | A | * | 12/1998 | Roman et al. | 220/575 |

* cited by examiner

*Primary Examiner*—Nathan J. Newhouse
(74) *Attorney, Agent, or Firm*—Kremblas, Foster, Phillips & Pollick

(57) ABSTRACT

A food tray delivery system is provided having an upper surface, at least one food retention area, and a cover. The food retention area has a food retention area upper surface and a food retention area sidewall extending generally upwardly from the food retention area upper surface. The food retention area upper surface is spaced a distance below the upper surface and has a peripheral edge. The upper surface has a rib projecting upwardly adjacent the upper surface, with the rib above the upper surface having a width of less than 2 mm and a height of less than 2 mm and with the cover being secured to the upwardly projecting rib, preferably at its upper surface. In one embodiment of the invention, an intermediate raised area is positioned between the upper surface and the rib above the upper surface. The food tray delivery system preferably includes a plurality of food retention areas, with each of the retention areas having a respective food retention area sidewall separating the food retention areas from one another. Preferably, the rib above the upper surface has a width of less than 1 mm and a height of less than 1.5 mm. More preferably, the rib has a width of less than 1 mm and a height in the range of between 0.5–1.5 mm. In the preferred embodiment of the invention, the rib above the upper surface is positioned intermediate the upper surface peripheral edge and all the food retention areas. More preferably, the rib above the upper surface is also positioned intermediate at least two food retention areas. Most preferably, an upwardly extending rib extends around each food retention area.

20 Claims, 4 Drawing Sheets

FOOD DELIVERY TRAY WITH RIBBED UPPER SURFACE

FIELD OF THE INVENTION

This invention concerns an improved food delivery tray, and more specifically one which features a ribbed component extending upwardly from the upper surface of the tray, at least about its periphery.

BACKGROUND OF THE INVENTION

The ingestion of food is a necessity in order for an individual to survive. Many individuals are able to partake of food at a location of their own choosing. However, some individuals experience periods of confinement, during which food must be brought to them. For example, an individual may be confined to a hospital or nursing home bed. Or, an individual who is able to walk about their home may need a meal periodically delivered there, either due to their inability to prepare appropriate portions of food or perhaps due to economic hardship. Finally, there is the extremely large inmate population at correctional institutions, many of whom have their meals brought to their prison cell.

Regardless of the environment, food delivery systems have designed reusable food delivery trays for use in such situations. Many of these trays are fabricated from a high temperature plastic, polycarbonate, or polypropylene. Due to the variety of foods served to these individuals at any one meal, the food trays have been partitioned into food retention areas, so as to typically accommodate one type of food in each food retention area. The presence of individual food retention areas keeps syrups, juices, or sauces associated with any one product from coming into contact with an adjacent food selection, thus possibly adversely affecting the aesthetic taste associated with that food. Examples of these type of food trays are Bitel, U.S. Pat. No. 5,419,451 and Anderson, U.S. Des. Pat. No. 318,207.

As noted above, there are several environments in which reusable food delivery trays are commonly used. For ease of preparation and distribution, the various foods are placed in the predetermined tray compartment and a covering is then placed so as to cover the upper surface of the tray. This covering may be in the form of a lid, of the type shown in Bitel, U.S. Pat. No. 5,419,451, or in the form of a plastic sheet-like film.

There are advantages associated with the use of the aforementioned film. For example, in actual use, the tray and its corresponding film covering can be placed into a cooking environment, such as an oven. In the cooking environment, the plastic film tends to melt or otherwise adhere itself to the upper surface of the tray. Thus, when the tray is removed from the cooking environment, the food held in the tray is precluded from coming into contact with the air outside the container, thereby keeping dust, germs, and other contaminants away from the food.

When one of the film covered food trays is distributed to the actual consumer of the food, the plastic film may be peeled off and the food eaten. Following ingestion of the food, the tray is collected for washing at a central location with other similar trays, such that the plastic food tray can be recycled. However, there are certain drawbacks associated with this particular type of tray. For example, over time, the area where the film contacts the upper surface of the tray develops a noticeable film residue. This residue tends to make the tray, or at least a portion thereof, appear dirty, thereby making the food served thereon less appetizing. Of course the residue can be removed with more extensive cleaning, but this can be time consuming, and thus relatively expensive, especially where hundreds or thousands of such trays need to be cleaned each day. More often than not, this problem is solved by either letting the consumer eat on what appears to be a dirty tray, or just throwing the clean, albeit unattractive, tray into the trash and buying a new one.

One proposed solution to the "film" problem is the fabrication of a delivery tray having a number of compartments, with that particular tray system also having a lid. However, although the tray does not develop the undesirable film coating over time, the delivery tray does not allow the food to be kept free of dust, germs, or other contaminants since the space between the tray and the lid is normally not airtight.

It is thus apparent that the need exists for an improved food delivery tray or the like for use with food delivery systems.

SUMMARY OF THE INVENTION

The problems associated with developing a food delivery tray system are overcome in accordance with the present invention by forming of a food tray delivery system for serving food to an individual, with the food tray delivery system having a tray with an upper surface and at least one food retention area. The food retention area has a food retention area upper surface and a food retention area sidewall extending generally upwardly from the food retention area upper surface. The food retention area upper surface is spaced a distance below the upper surface and has a peripheral edge. The upper surface has a rib projecting upwardly adjacent the upper surface, with the rib being of a width of less than 2 mm and being of a height of less than 2 mm. In one embodiment of the invention, an intermediate raised area is positioned between the upper surface and the rib above the upper surface.

The food tray in its preferred embodiment includes a plurality of food retention areas, with each of these food retention areas having a respective food retention area sidewall separating each of the food retention areas from one another. Preferably the rib above the upper surface has a width of less than 1 mm and a height of less than 1.5 mm. More preferably, the rib above the upper surface has a width of less than 1 mm and a height in the range of between 0.5–1.5 mm. The rib above the upper surface is positioned intermediate the upper surface peripheral edge and at least one food retention area. In the preferred embodiment of the invention, the rib above the upper surface is positioned intermediate the upper surface peripheral edge and all the food retention areas. More preferably, the rib above the upper surface is also positioned intermediate at least two food retention areas. Most preferably, an upwardly extending rib extends around each food retention area. The plastic film cover is retained on the tray where it is in contact with the rib. More preferably, the cover is retained in contact with the tray where it is in contact with the upper surface of the rib.

There is also disclosed a food tray delivery system for serving food to an individual, with the food tray having an upper surface and at least one food retention area, and a cover. The food retention area has a food retention area upper surface and a food retention area sidewall extending generally upwardly from the food retention area upper surface. The food retention area upper surface is spaced a distance below the upper surface and has a peripheral edge. The upper surface has a rib projecting upwardly adjacent the upper surface, with the rib above the upper surface having a width of less than 2 mm and a height of less than 2 mm and with the cover being secured to the upwardly projecting rib. In one embodiment of the invention, an intermediate raised area is positioned between the upper surface and the rib above the upper surface.

The food tray delivery system includes a plurality of food retention areas, with each of the retention areas having a respective food retention area sidewall separating the food retention areas from one another. Preferably, the rib above the upper surface has a width of less than 1 mm and a height of less than 1.5 mm. More preferably, the rib has a width of less than 1 mm and a height in the range of between 0.5–1.5 mm. In the preferred embodiment of the invention, the rib above the upper surface is positioned intermediate the upper surface peripheral edge and all the food retention areas. More preferably, the rib above the upper surface is also positioned intermediate at least two food retention areas. Most preferably, an upwardly extending rib extends around each food retention area. The plastic film cover is retained on the tray where it is in contact with the upwardly extending rib. More preferably, the cover is retained in contact with the tray where it is in contact with the upper surface of the upwardly extending rib.

It is the primary object of the present invention to provide a food delivery tray which is reusable, and able to appear relatively clean after prolonged use.

A further objective is that such a food delivery tray be easy and inexpensive to fabricate.

Other objects and advantages of the invention will be apparent from the following description, the accompanying drawings and the appended claims.

DETAILED DESCRIPTION OF THE INVENTION

Figure 1:
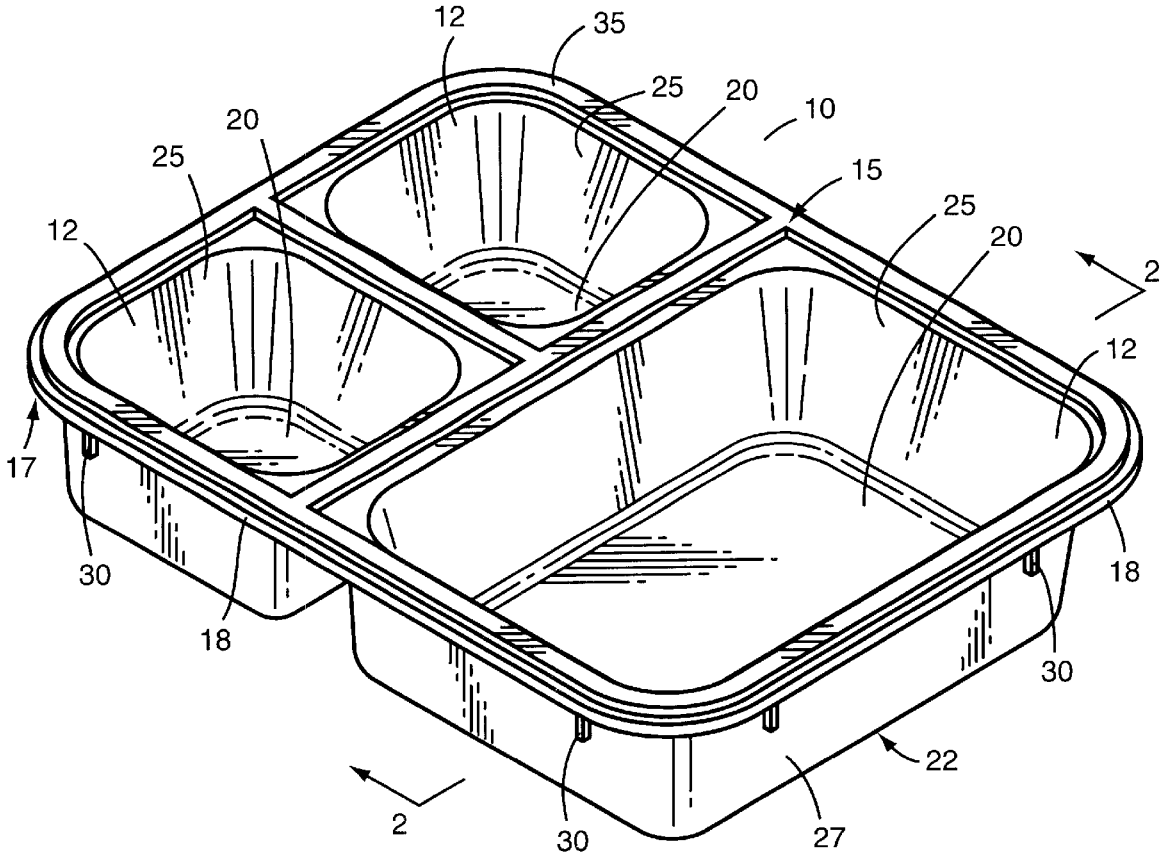
Fig. 1 Prior Art
FIG. 1. is a perspective view of a container for use as a food delivery tray made in accordance with the prior art.

Having reference to the drawings, attention is first directed to FIG. 1 which discloses a food tray delivery system of the type found in the prior art with this prior art type of food tray delivery system being designated generally by the numeral 10. Pre-existing food trays have included at least one food retention area 12, with the drawing showing three such areas. As can be appreciated by a comparison of FIGS. 1 and 2, the pre-existing trays also include an upper surface 15, a lower surface 17, and a peripheral edge 18. Each food retention area 12 has a food retention upper surface 20 and a food retention area bottom surface 22, in addition to a food retention area inner sidewall 25 and a food retention area outer sidewall 27. The food retention inner sidewall 25 often is configured so as to have a flat section 25*a* adjacent its top and a curved portion 25*b* between the flat section 25*a* and the bottom surface 22. Near the top of the food retention area outer sidewall 27 and extending upwardly to lower surface 17 are formed a plurality of sidewall nubs or ribs 30. These typically linear ribs assist with structural stability as well as facilitate stacking of the trays, with these sidewall ribs on a given tray resting against the food retention area inner sidewall of a similarly configured tray stacked directly below.

In many such prior art food trays 10, the upper surface 15 features a slightly raised portion 35, configured so as to assist in the securing of a cover onto the tray. This attachment portion or raised portion 35, while less than 1 mm in height is approximately 3–4 mm wide as can best be seen in FIG. 1. As can also be appreciated from FIG. 1, this raised portion 35 extends not only around the periphery of the food tray 10 but also intermediate each of the separate food retention areas 12. In actual use, as can best be appreciated from FIG. 2, a sheet-form cover 60 preferably of a plastic or other composition well known in the art as being able to be sealed onto the attachment portion 35 of food tray 10. In order to provide for a sufficient seal, the teaching of the prior art has been to form the attachment portion 35 with a planar top surface, and with the overall cross sectional configuration of the raised portion 35 approximating a rectangle. The furnishing of an attachment portion with a width of about 4 mm has been viewed as important in facilitating a good sealing of the tray.

Figure 2:
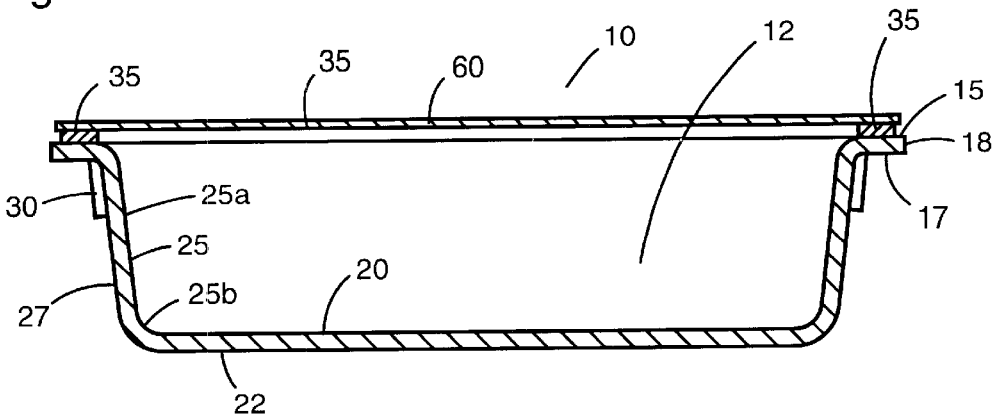
Fig. 2 Prior Art
FIG. 2 is a vertical sectional view taken along line 2—2 of FIG. 1 illustrative of the prior art, but also showing the tray as being sealed.
Figure 3:
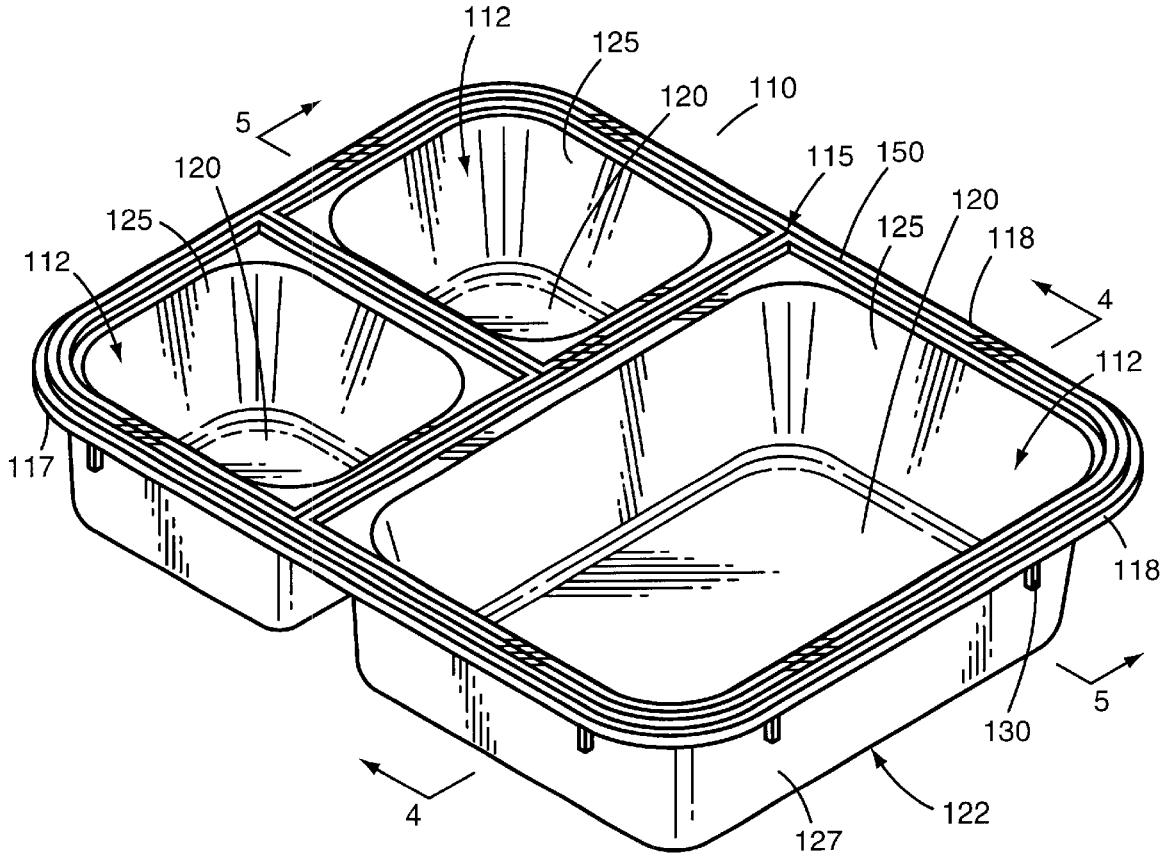
FIG. 3 is a perspective view of a container for use as a food delivery tray made in accordance with the invention.
Figure 4:
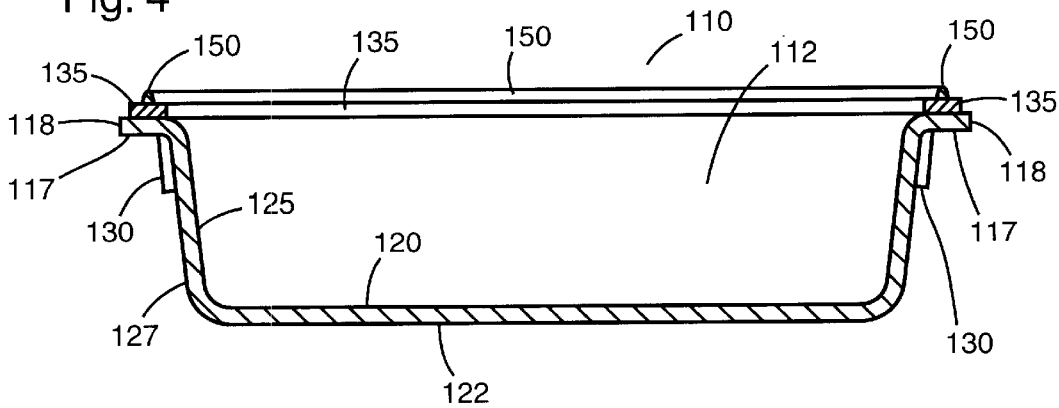
FIG. 4 is a vertical sectional view, similar to FIG. 2, taken along line 4—4 of FIG. 3.
Figure 5:
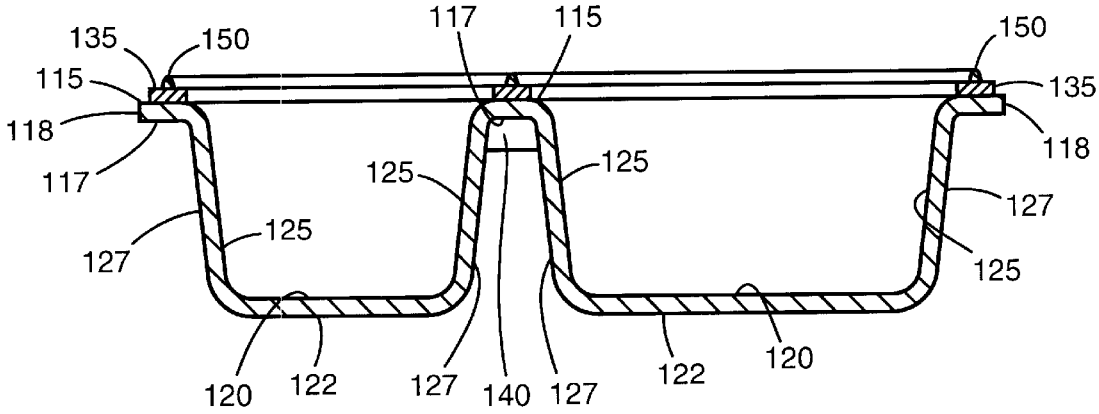
FIG. 5 is a vertical sectional view taken along line 5—5 of FIG. 3.

The drawbacks associated with the food trays as shown in FIGS. 1 and 2 have been overcome by the fabrication of a food tray as shown in FIG. 3. As can be appreciated from a comparison of FIGS. 3–9, the food tray 110 made in accordance with this invention also features at least one food retention area 112, with there preferably being more than one. As shown in the drawings, the number of food retention areas in the embodiment is shown as being three. In addition to the food retention area 112, the food tray 110 has an upper surface 115 and a lower surface 117, shown as being roughly parallel thereto with a peripheral edge 118 being roughly perpendicular to both the upper surface 115 and the lower surface 117.

Each food retention area 112 has a food retention area upper surface 120 and a food retention area bottom surface 122. Additionally, each food retention area has an inner sidewall 125. In the preferred embodiment of the invention, there is a flat portion 125*a* of the wall directly below the upper surface 115 as well as a lower curved portion 125*b* just above the upper surface 120. On the opposite side of each food retention area inner sidewall 125 is a food retention area outer sidewall 127. Although the food retention inner sidewall may be formed of a variety of configurations, such as circles, squares, or other geometric shapes, the drawings depict each of the food retention areas 112 as having four sidewalls, with each of the food retention areas being of a generally rectangular configuration.

As in the prior art, nubs or sidewall ribs 130 are located near the upper portion of each of the food retention area outer sidewalls. Adjacent the periphery and below lower surface 117, these nubs assist in the stacking of the food trays 110. Located directly beneath the lower surface 117 and spanning the distance between opposed food retention area outer sidewalls are food retention area ribs 140. These ribs which also can be found in prior art food trays serve to provide additional structural integrity for the food tray 110.

The important distinction between the food tray 110 associated with this invention and the prior art food trays concerns how the cover 160 is secured to the food tray 110. Instead of the sheet-form cover member 160 being secured to solely the upper surface of the raised planar attachment portion 135, the food tray associated with this invention utilizes an upper surface rib 150. This upper surface rib 150 is located along the length of the attachment portion 135 and features a rib sidewall 155 and a rib apex 157. In the event that the food tray does not have a raised portion 135 similar to that associated with the prior art, the upper surface rib would be located directly on the upper surface 115. In either event, the upper surface rib extends upwardly above upper surface 115.

Figure 6:
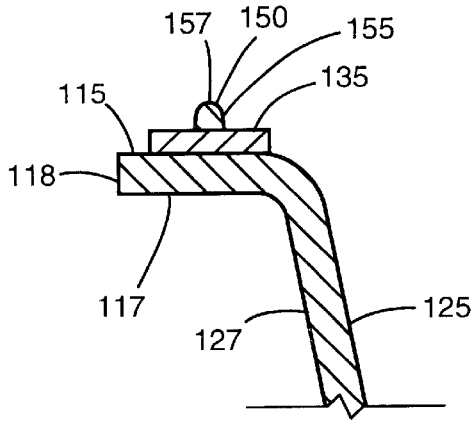
FIG. 6 is a fragmentary vertical sectional view on a greatly enlarged scale of the edge of the upper surface of the food delivery tray of this invention shown in FIG. 5.
Figure 7:
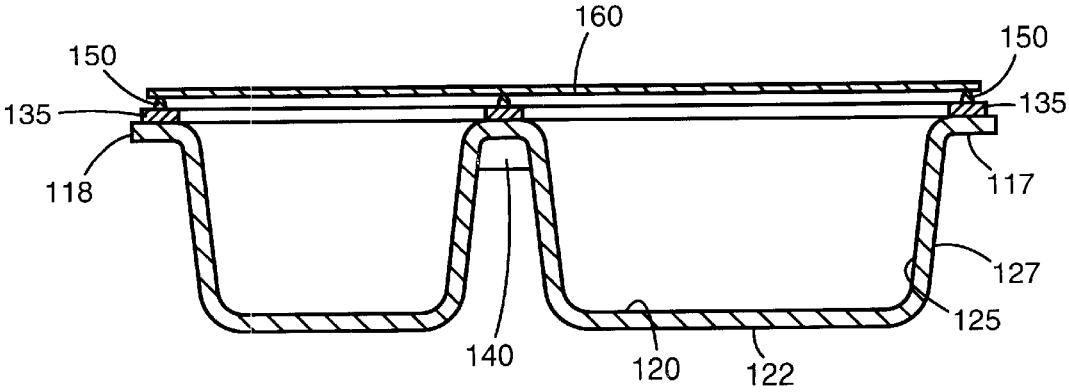
FIG. 7 is a vertical sectional view similar to FIG. 5, but showing a food delivery tray associated with the invention when sealed.
Figure 8:
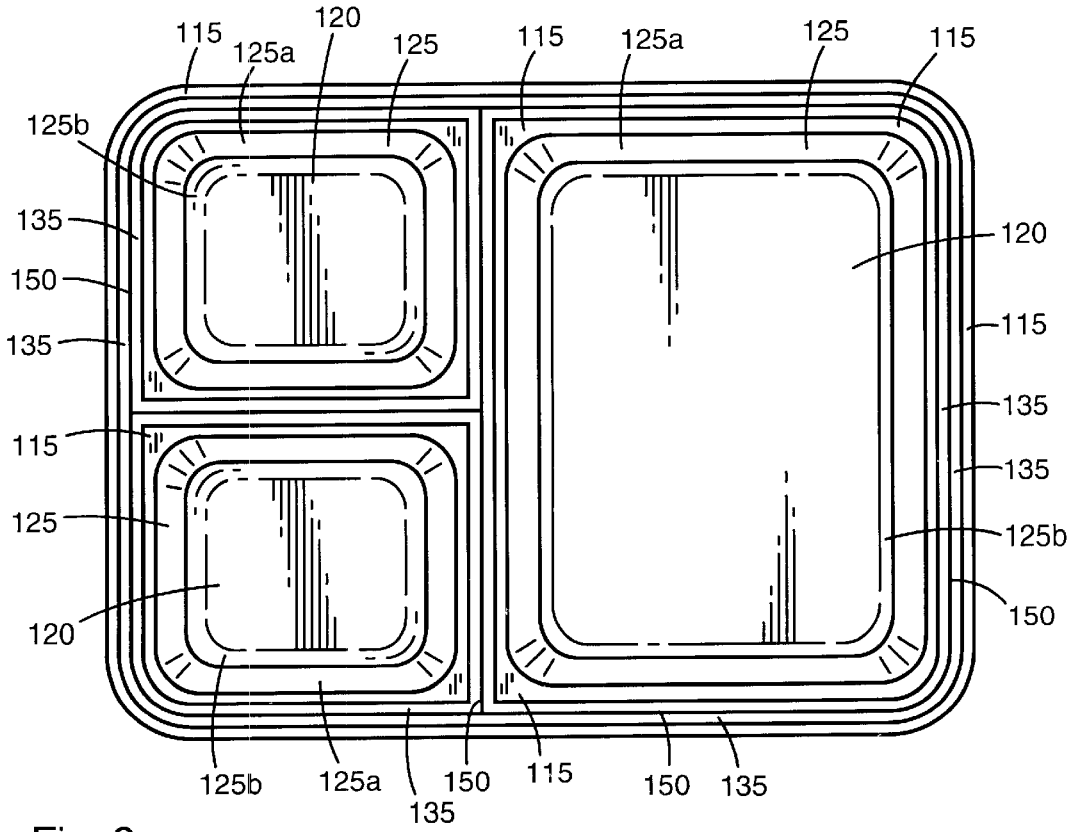
FIG. 8 is a top plan view of the food delivery tray shown in FIG. 3.

Furthermore, as can be appreciated best from FIG. 6, the rib apex 157 is generally rounded at the top, however, if there is any planar component associated with the rib apex, the width dimension of that planar component should still be less than 1 mm. As shown, the upwardly projecting rib 150 which is adjacent the upper surface 115 has a width of less than 2 mm as well as a height of less than 2 mm. More preferably, the rib has a width of less than 1 mm and a height of less than 1.5 mm. Most preferably, the rib has a width of less than 1 mm and a height in the range of between 0.5–1.5 mm. Thus, as can be appreciated from FIG. 6, while the width of the attachment portion is preferably between 3–4 mm, the rib 150 is positioned in the preferred embodiment of the invention at the mid-point of the width of the attachment portion.

Figure 9:
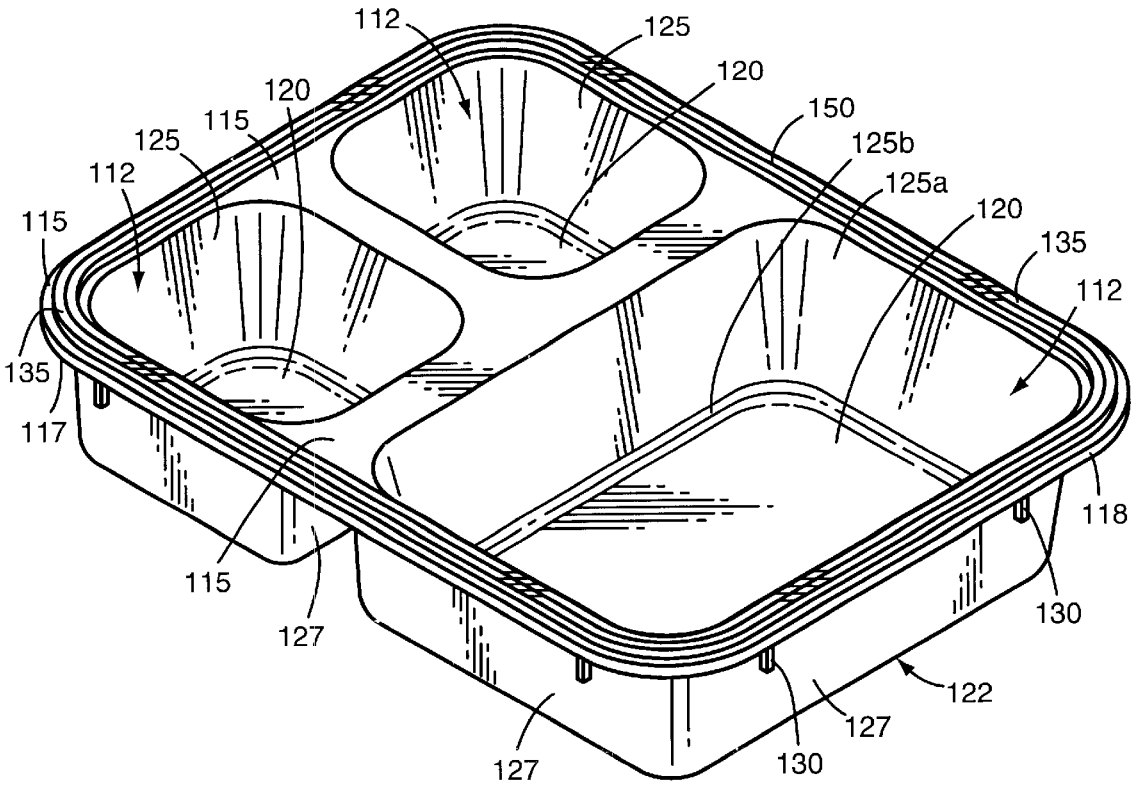
FIG. 9 is a perspective view of a container for use as a food delivery tray made in accordance with a modification of the invention.

One modified embodiment of the invention is shown in FIG. 9. The difference between this particular food tray and that which is shown in FIG. 3 should be readily apparent. In FIG. 9, the upper surface rib extends only around the periphery of the tray, while in FIG. 3, the upper surface rib also extends between at least two and preferably between all of the food retention areas.

In actual use, preferably the components of this food tray delivery system are fabricated from a material such as polypropylene, polycarbonate, or other suitable high temperature plastic which can sustain temperatures of up to 400° F. during the sealing process without deformation of the tray occurring. Similarly, the sheet-form cover 160 which is secured to the food tray by either adhesive means and/or heat is of the type well known in the art, and has a very minimal thickness.

The food tray delivery system 110 associated with this invention facilitates the reusing of food trays that are aesthetically pleasing to their users. This is true because the tray does not acquire a filmy appearance due to the repeated use of plastic film whose adhesive, along with some of the film, remains on the tray even after washing.

While the form of apparatus herein described constitutes a preferred embodiment of the invention, it is to be understood that the invention is not limited to this precise form of apparatus, and that changes may be made therein without departing from the scope of the invention which is defined in the appended claims.

What is claimed is:

1. A food tray delivery system for serving food to an individual comprising a food tray, said food tray comprising an upper surface and at least one food retention area, said food retention area comprising a food retention area upper surface and a food retention area sidewall extending generally upwardly from said food retention area upper surface, said food retention area upper surface being spaced a distance below said upper surface, said upper surface having a peripheral edge, said upper surface having a rib projecting upwardly adjacent said upper surface, said rib located inwardly of said peripheral edge of said upper surface, said rib having a width of less than 2 mm and a height of less than 2 mm, said food tray comprising an intermediate raised area positioned between said upper surface and said rib above said upper surface.

2. The food tray delivery system according to claim 1 wherein said rib has a width of less than 1 mm and a height of less than 1.5 mm.

3. The food tray delivery system according to claim 1 wherein said rib has a width of less than 1 mm and a height in the range of between 0.5–1.5 mm.

4. The food tray delivery system according to claim 1 wherein said rib is positioned intermediate said upper surface peripheral edge and at least one food retention area.

5. The food tray delivery system according to claim 1 wherein said food tray includes a plurality of food retention areas, each of said food retention areas having a respective food retention area sidewall separating said food retention areas.

6. The food tray delivery system according to claim 5 wherein said rib is positioned intermediate said upper surface peripheral edge and at least one food retention area.

7. The food tray delivery system according to claim 6 wherein said rib is positioned intermediate at least two food retention areas.

8. The food tray delivery system according to claim 6 wherein said upwardly extending rib extends around each food retention area.

9. A food tray delivery system for serving food to an individual comprising, a food tray, said food tray comprising an upper surface and at least one food retention area, said food retention area comprising a food retention area upper surface and a food retention area sidewall extending generally upwardly from said food retention area upper surface, said food retention area upper surface being spaced a distance below said upper surface, said upper surface having a peripheral edge, said upper surface having a rib projecting upwardly adjacent said upper surface, said rib located inwardly of said peripheral edge of said upper surface, said rib having a width of less than 2 mm and a height of less than 2 mm, said food tray comprising an intermediate raised area positioned between said upper surface and said rib above said upper surface and, a cover, said cover being secured to said upwardly projecting rib.

10. The food tray delivery system according to claim 9 wherein said rib has a width of less than 1 mm and a height of less than 1.5 mm.

11. The food tray delivery system according to claim 9 wherein said rib has a width of less than 1 mm and a height in the range of between 0.5–1.5 mm.

12. The food tray delivery system according to claim 9 wherein said rib is positioned intermediate said upper surface peripheral edge and said food retention area.

13. The food tray delivery system according to claim 9 wherein said cover is retained on said tray where said cover is in contact with said upwardly extending rib.

14. The food tray delivery system according to claim 9 wherein said upwardly extending rib has an upper surface, said cover being retained in contact with said tray where said cover is in contact with said upper surface of said upwardly extending rib.

15. The food tray delivery system according to claim 9 wherein said food tray includes a plurality of food retention areas, each of said retention areas having a respective food retention area sidewall separating said food retention areas.

16. The food tray delivery system according to claim 15 wherein said rib is positioned intermediate said upper surface peripheral edge and at least one food retention area.

17. The food tray delivery system according to claim 16 wherein said rib is positioned intermediate at least two food retention areas.

18. The food tray delivery system according to claim 17 wherein said upwardly extending rib extends around each food retention area.

19. A food tray delivery system for serving food to an individual comprising a food tray, said food tray comprising an upper surface and at least one food retention area, said food retention area comprising a food retention area upper surface and a food retention area sidewall extending generally upwardly from said food retention area upper surface, said food retention area upper surface being spaced a distance below said upper surface, said upper surface having a peripheral edge, said upper surface having a rib projecting upwardly adjacent said upper surface, said rib located inwardly of said peripheral edge of said upper surface, said food tray comprising an intermediate raised area positioned between said upper surface and said rib above said upper surface.

20. The food tray delivery system according to claim 19 wherein said intermediate raised area has first width, said rib has a second width, with said second width being less than said first width, said rib located directly atop said intermediate raised area.

* * * * *